US006491006B2

(12) United States Patent
Jonsson et al.

(10) Patent No.: US 6,491,006 B2
(45) Date of Patent: Dec. 10, 2002

(54) CHAIN SAW HAVING A TWO-CYCLE OR TWO-STROKE ENGINE, AND A HAND-HELD POWER TOOL SUCH AS A CHAIN SAW, TRIMMER, OR POWER CUTTER HAVING A TWO-CYCLE OR TWO-STROKE ENGINE, AND A METHOD FOR THE CONSTRUCTION THEREOF

(75) Inventors: Bo Jonsson, Habo (SE); Mats Svensson, Huskvarna (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/849,782

(22) Filed: May 4, 2001

(65) Prior Publication Data

US 2002/0005180 A1 Jan. 17, 2002

Related U.S. Application Data

(63) Continuation-in-part of application No. PCT/SE99/01961, filed on Nov. 1, 1999.

(30) Foreign Application Priority Data

Nov. 4, 1998 (SE) ..... 9803752

(51) Int. Cl.[7] ..... F02B 33/04
(52) U.S. Cl. ..... 123/73 R

(58) Field of Search ..... 123/73 R, 73 A, 123/73 PP, 73 SC, 73 AE, 73 AF, 195 C

(56) References Cited

U.S. PATENT DOCUMENTS

| | | | | |
|---|---|---|---|---|
| 1,353,465 A | | 9/1920 | Edwards | |
| 1,360,383 A | | 11/1920 | Edwards | |
| 4,204,488 A | | 5/1980 | Onishi | |
| 4,204,489 A | | 5/1980 | Onishi | |
| 4,213,431 A | | 7/1980 | Onishi | |
| 4,773,365 A | * | 9/1988 | Nagashima | 123/195 C |
| 6,148,524 A | * | 11/2000 | Nitschmann | 30/383 |
| 6,155,246 A | * | 12/2000 | Yamami et al. | 125/13.01 |
| 6,158,636 A | * | 12/2000 | Latiolais | 224/258 |

* cited by examiner

*Primary Examiner*—Gene Mancene
*Assistant Examiner*—Hyder Ali
(74) *Attorney, Agent, or Firm*—Nils H. Ljungnam & Associates

(57) ABSTRACT

The present invention relates to a chain saw having a two-cycle or two-stroke engine. The present invention also relates to a hand-held power tool such as a chain saw, trimmer, or power cutter having a two-cycle or two-stroke engine. The present invention further relates to a method for the construction of a hand-held power tool such as a chain saw, trimmer, or power cutter having a two-cycle or two-stroke engine. The chain saw, trimmer, or power cutter has a housing for containing a two-cycle engine with a crank-case having scavenging ducts.

20 Claims, 10 Drawing Sheets

CHAIN SAW HAVING A TWO-CYCLE OR TWO-STROKE ENGINE, AND A HAND-HELD POWER TOOL SUCH AS A CHAIN SAW, TRIMMER, OR POWER CUTTER HAVING A TWO-CYCLE OR TWO-STROKE ENGINE, AND A METHOD FOR THE CONSTRUCTION THEREOF

CONTINUING APPLICATION DATA

This application is a Continuation-in-Part of International Application No. PCT/SE99/01961, filed on Nov. 1, 1999, which International Application claims priority from Swedish Patent Application No. 9803752-6, filed on Nov. 4, 1998. International Application No. PCT/SE99/01961 was pending as of the filing of this application. The United States was an elected state in International Application No. PCT/SE99/01961.

BACKGROUND OF THE INVENTION

1. Field of the Invention

The present invention relates to chain saw having a two-cycle or two-stroke engine. The present invention also relates to a hand-held power tool such as a chain saw, trimmer, or power cutter having a two-cycle or two-stroke engine. The present invention further relates to a method for the construction of a hand-held power tool such as a chain saw, trimmer, or power cutter having a two-cycle or two-stroke engine.

The subject of the invention also refers to a crankcase scavenged internal combustion engine, mainly intended for a handheld working tool, such as a chain saw, with an engine body comprising at least one crankcase body and a cylinder body, which are joined together, and the engine is equipped with so called elongated scavenging dues, which over some part of their length, i.e. a crankcase part, extend in the crankcase body and have their inlet there, and over another part of their length, i.e. a cylinder part, extend in the cylinder body. Generally the crankcase scavenged internal combustion engine is of two-stroke type, but it could also be a four-stroke engine as well as other applications not only meant for a handheld working tool.

2. Background of the Invention

Chain saws and other handheld tools, such as hedge or weed trimmers and power cutters, such as those used for cutting dry wall, are usually designed with consideration to convenience of use as well as other factors. One important factor is the overall weight of the chain saw or handheld tool since, obviously, a person using the tool must hold it for periods of time. An excessively large or heavy tool would be unwieldy and tiresome for the user to hold for an extended period of time. In that regard, many handheld tools utilize an internal combustion engine that is lightweight and easy to manufacture, usually a two-stroke or two-cycle engine.

Unfortunately, two-stroke or two-cycle engines sometimes can produce substantial amounts of pollutants or other emissions. They also can sometimes be inefficient with respect to fuel consumption. It therefore becomes advantageous to develop a two-stroke engine that has reduced emissions and improved fuel efficiency, yet at the same time is still lightweight and easy to manufacture.

Crankcase scavenged internal combustion engines with so called elongated scavenging ducts, i.e. scavenging ducts starting in the crankcase part, usually in its lower parts, are known since a long time. The elongated scavenging ducts will under certain conditions have a favorable effect on the scavenging and can thereby reduce both the fuel consumption and the exhaust emissions. The scavenging ducts in the crankcase part are produced in that a vertically-split crankcase is provided with cavities on both sides of the parting plane. When assembling the crankcase a large continuous scavenging duct is thus created by both of the cavities. In case the sealing in the parting plane is drawn right up to the inner side of the crankcase it will split the large duct into two scavenging ducts which often is preferable. Generally the inlet of the scavenging duct is formed already during the casting process.

This is rational from a production point of view but it requires a specific crankcase for each motor application with varying placement of the inlet. It is therefore preferable to adapt the length of the scavenging duct and/or the cross-section area of each application in order to, in this way, obtain optimum engine performance. Such an adaption for a specific crankcase can be achieved essentially only by machining the inlet of the scavenging duct instead of pre-casting it and this is costly. In the vertically-split crankcase a bearing position for each crankshaft bearing is positioned in each of the crankcase halves.

There are also internal combustion engines having a so called horizontally-split crankcase. It means that the crankcase is split at the center axis of the crankshaft and comprises essentially only one part. In that case a cylinder part contains the top crankcase half down to the center axis of the crankshaft. In this manner the engine body is thus made of only two parts instead of three when a vertically-split crankcase is used. The bearing positions of the crankshaft bearings are thus positioned in each part of the engine body and the bearings are clamped between the engine body parts. The applicant does not readily know of any example of an internal combustion engine with a horizontally-split crankcase having elongated scavenging ducts, even if this is preferable from many aspects.

OBJECT OF THE INVENTION

The purpose of the present invention is to substantially reduce the above outlined problems, and to achieve advantages in many respects.

SUMMARY OF THE INVENTION

The above mentioned purpose is achieved in a crankcase scavenged internal combustion engine in accordance with the invention and having the characteristic features as described in the features of the invention herein below.

The crankcase scavenged internal combustion engine according to the invention is thus essentially characterized in that the crankcase part of at least one scavenging duct to a great extent comprises an insert part with at least one inner wall facing the crankshaft assembly and provided with the inlet, so that the crankcase part of the scavenging duct is comprised of the insert part alone or in combination with the inner side of the crankcase body, and leads from the inlet to an outlet intended to connect to the cylinder part of the scavenging duct. Through this insert part with the inner wall facing the crankshaft assembly and provided with the inlet of the scavenging duct, possibilities are created to supply a horizontally-split crankcase with scavenging ducts in the crankcase part so that elongated scavenging ducts are achieved. For a vertically-split crankcase, this insert part implies improved flexibility. Since the inlet of the scavenging duct is located in the inner wall of the insert part, the inlet of the scavenging duct can be moved by replacing the insert part. This means that with the aid of several different insert parts a specific crankcase can be adapted for many different motor applications. Adaption of both length and/or area of the scavenging ducts can be made, so that many different ratios of length/area of the scavenging ducts are achieved. Obviously this is a big advantage, both for a horizontally-split and for a vertically-split crankcase, since it offers opportunities, both in the development stage and in the serial production, to make changes quickly and easily.

To further explain, the scavenging ducts can be configured in many different dimensions and/or shapes to achieve or modify different engine characteristics. The length, width, depth, cross-sectional area and/or shape of the duct can be modified to effect engine tuning, horsepower, range of revolutions per minute (RPM), torque, and, as discussed above, fuel consumption and emissions. The scavenging duct can therefore be designed in particular shapes and sizes depending on the engine and its desired engine characteristics.

Further, the insert allows for tailoring of the engine with the same crankcase. The insert can be modified, while the crankcase can remain the same. Thus, production costs can be reduced because different crankcases will not have to be produced for each individual engine if the engine requires different engine characteristics, such as piston structure, cylinder displacement, and shifting the RPM at which a desired horsepower or horsepower curve(s) are generated or at which a desired torque or torque characteristic are desired. Therefore, even with the same cylinder and piston, the characteristics of a two-stroke engine can be changed by changing the various parameters as indicated in the above paragraphs.

Further, in at least one possible embodiment, the scavenging duct can extend around a substantial portion of the crankcase body to further achieve different engine characteristics as described above. For example, the scavenging duct could extend past the six o'clock position at the bottom of the crankcase up to, for example, the eight or eight-thirty position near the side of the crankcase.

Also, the insert can provide advantages relating to cost over cast crankcases. Cast crankcases can be extremely expensive to produce with some degree of precision. An insert can be modified as discussed above, but can be used on the same crankcase. Thus, only one crankcase type may need to be made, thereby reducing cost by avoiding the casting of different crankcases for particular uses.

Such an insert of the type described above is manufactured by Veinge Plast, which is a manufacturer located at Kraftgatan 1, 31234 Laholm, Sweden. Although the insert can be made from a variety of materials, such as plastic or metal, a type of plastic that can preferably be used in making the insert, according to at least one embodiment of the present invention, is a plastic material called "Akulon." Akulon is produced by a company called DSM, whose home office is located at Het Overloon 1, 6411 TE Heerlen, the Netherlands. Akulon comprises two main components, namely Polyamide 6, which is also manufactured by DSM, and 45% added glass fiber (PA6+45% GF). DSM also has an internet world wide web (WWW) site that provides summaries and information regarding its products, such as Akulon and Polyamide 6, and services. The address of DSM's web site is "http://www.dsm.nln".

The insert can be used, as discussed above, in engines in a variety of machinery, such as chain saws, hedge and weed trimmers, power cutters, leaf blowers, and possibly even lawn mowers. Husqvarna AB is a company that produces such machinery that could use the insert. Husqvarna AB's mailing address is SE-561 82 Huskvarna, Sweden. Husqvarna AB's internet web site address is "http://international.husqvarna.com". Many examples of different machinery and products that could use an insert as described above can be found on the web site and in Husqvarna product catalogs that can be obtained from the company.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and nonobvious one with respect to the other.

BRIEF DESCRIPTION OF THE DRAWINGS

The invention will be described in closer detail in the following by way of various embodiments thereof with reference to the accompanying drawing figures.

DESCRIPTION OF THE PREFERRED EMBODIMENT

Figure 6:
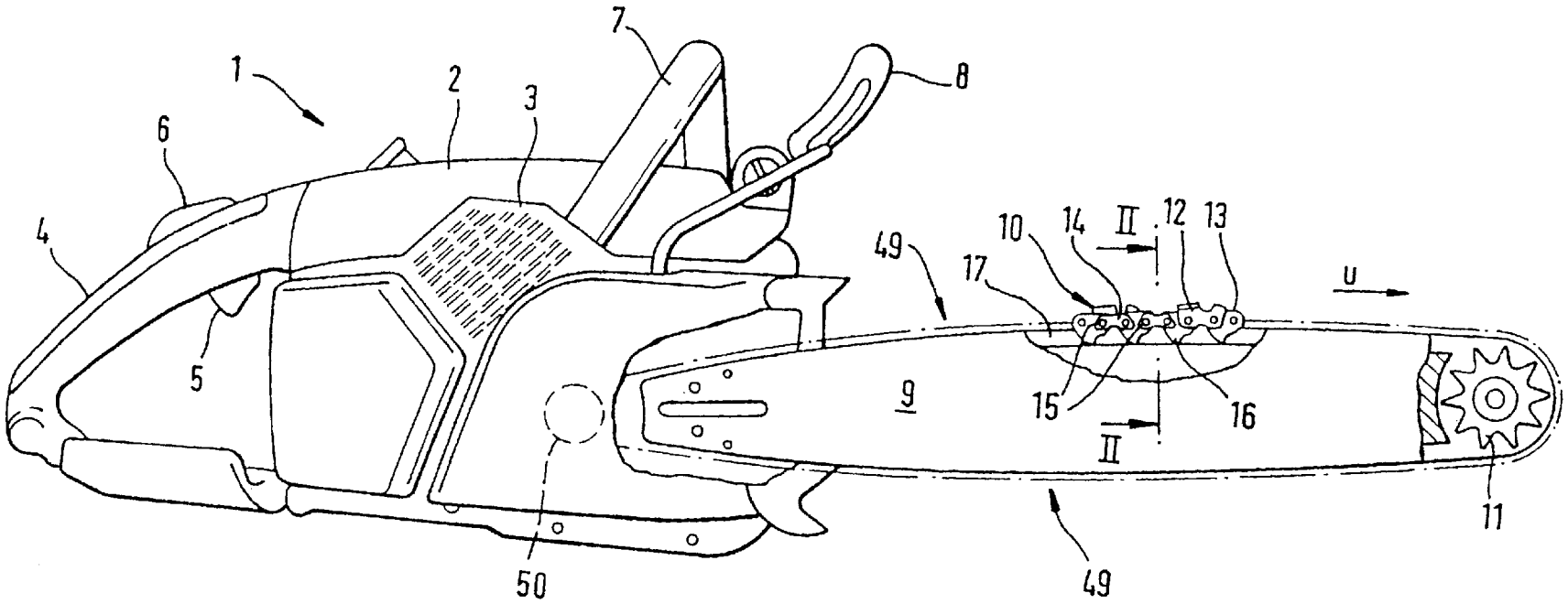
FIG. 6 shows a chain saw.

FIG. 6 shows a chain saw. The chain saw has a housing and a handle for a user to hold the chain saw. The chain saw has a blade and a chain disposed about the blade. The chain is rotated about the blade for cutting objects such as trees. An engine, such as the type described herein, can be disposed in the housing and configured to provide power to move the chain about the blade. FIG. 6 corresponds to the figure numbered "1" in U.S. Pat. No. 6,148,524, issued on Nov. 21, 2000. The reference numerals are listed and the figure described in U.S. Pat. No. 6,148,524, which is incorporated by reference herein.

Figure 7:
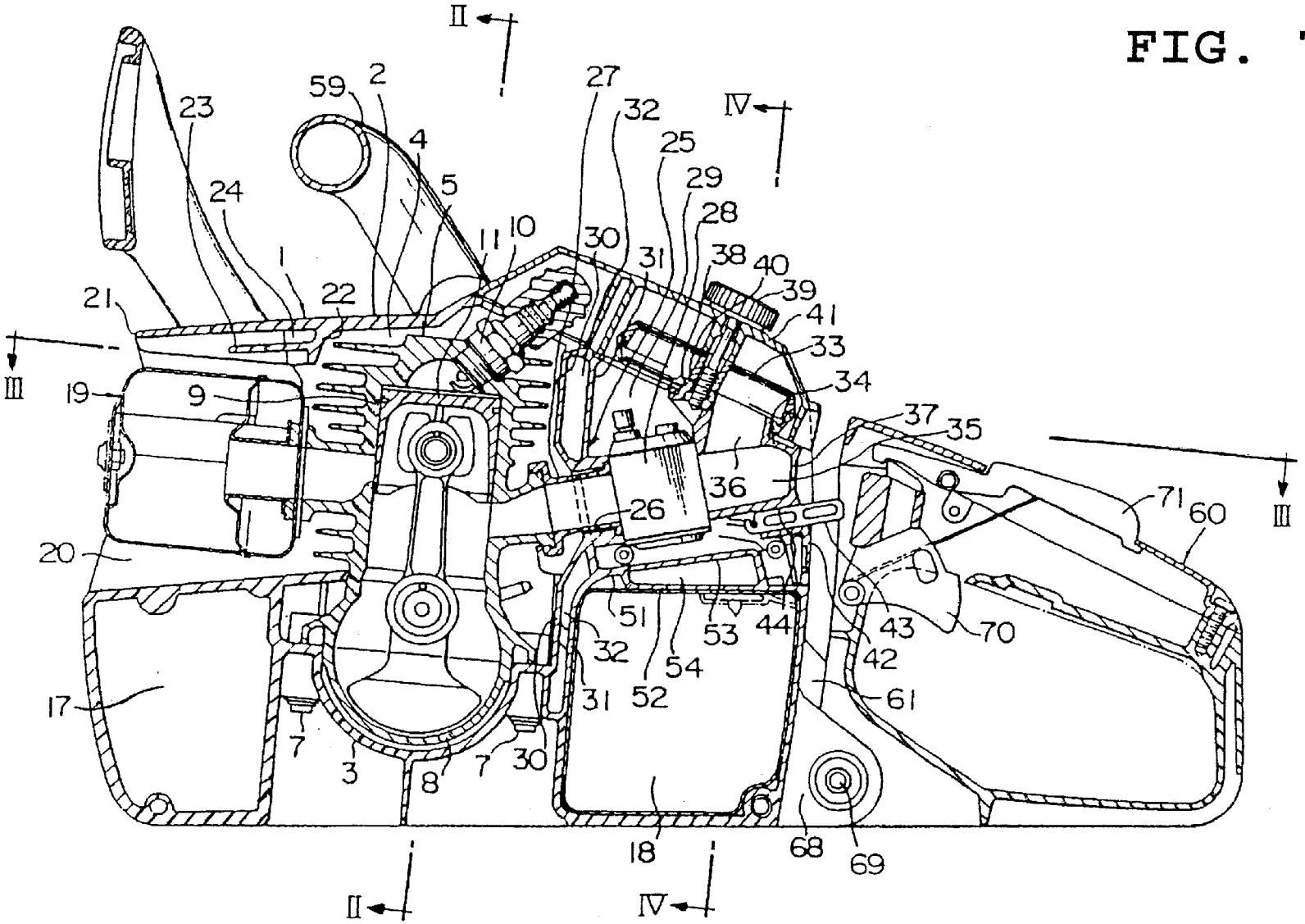
FIG. 7 shows a body of a chain saw having an internal combustion engine.

FIG. 7 shows a body of a chain saw having an internal combustion engine. The chain saw has a housing and a handle for a user to hold the chain saw. An engine, such as the type described herein, is disposed in the housing and configured to provide power to move a chain about a blade connected to the housing but not shown here. FIG. 7 corresponds to the figure numbered "1" in U.S. Pat. No. 4,773,365, issued on Sep. 27, 1988. The reference numerals are listed and the figure described in U.S. Pat. No. 4,773,365, which is incorporated by reference herein.

Figure 8:
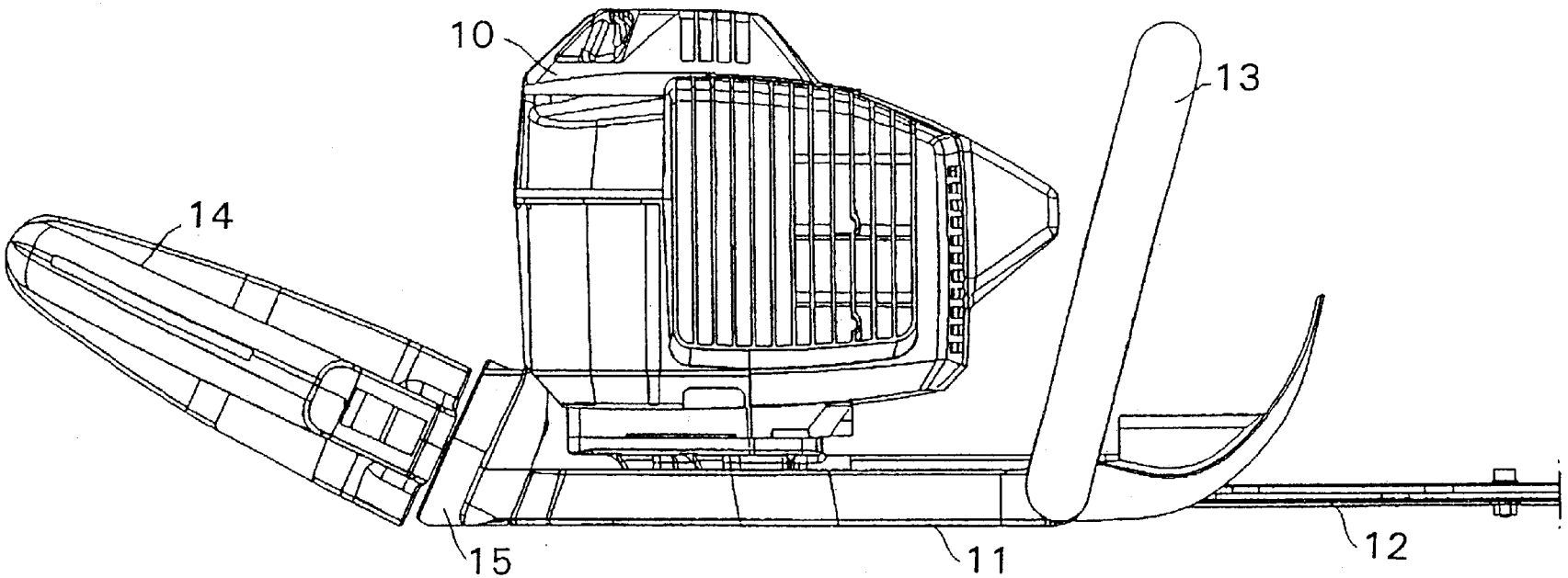
FIG. 8 shows a side view of a hedge trimmer.

FIG. 8 shows a side view of a hedge trimmer. The hedge trimmer has a housing and a handle for a user to hold the hedge trimmer. The hedge trimmer has a toothed blade. The toothed blade is moved back and forth to trim objects such as bushes and hedges. An engine, such as the type described herein, can be disposed in the housing and configured to provide power to move the toothed blade. FIG. 8 corresponds to the figure numbered "2" in U.S. Pat. No. 5,778,649, issued on Jul. 14, 1998. The reference numerals are listed and the figure described in U.S. Pat. No. 5,778,649, which is incorporated by reference herein.

Figure 9:
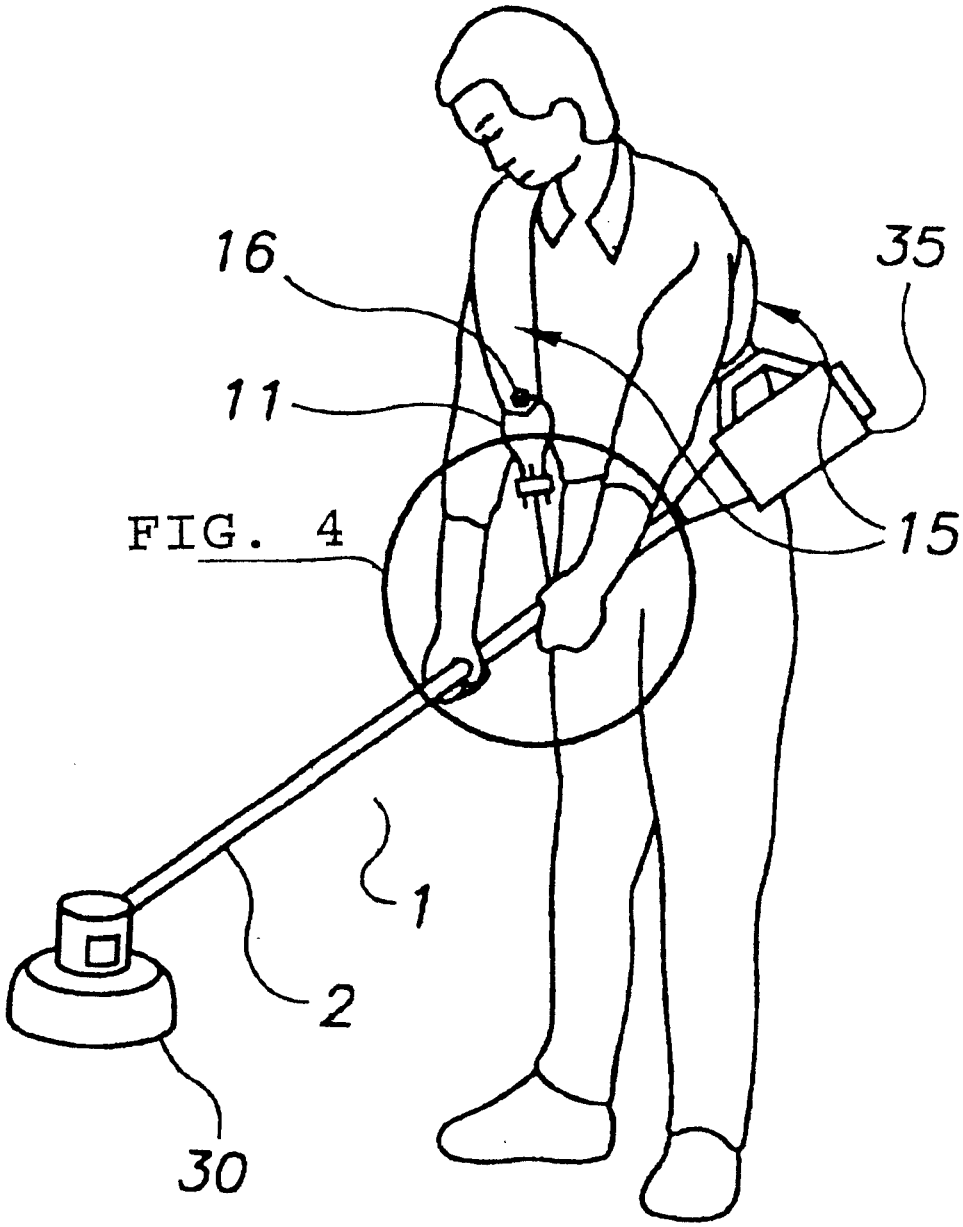
FIG. 9 shows a man using a weed trimmer.

FIG. 9 shows a man using a weed trimmer. The weed trimmer has a housing, a shaft, and a cutting mechanism located on the end of the shaft. The cutting mechanism is used to cut objects such as grass and weeds. An engine, such as the type described herein, can be disposed in the housing and configured to provide power to move the toothed blade. FIG. 9 corresponds to the figure numbered "5" in U.S. Pat. No. 6,158,636, issued on Dec. 12, 2000. The reference numerals are listed and the figure described in U.S. Pat. No. 6,158,636, which is incorporated by reference herein.

Figure 10:
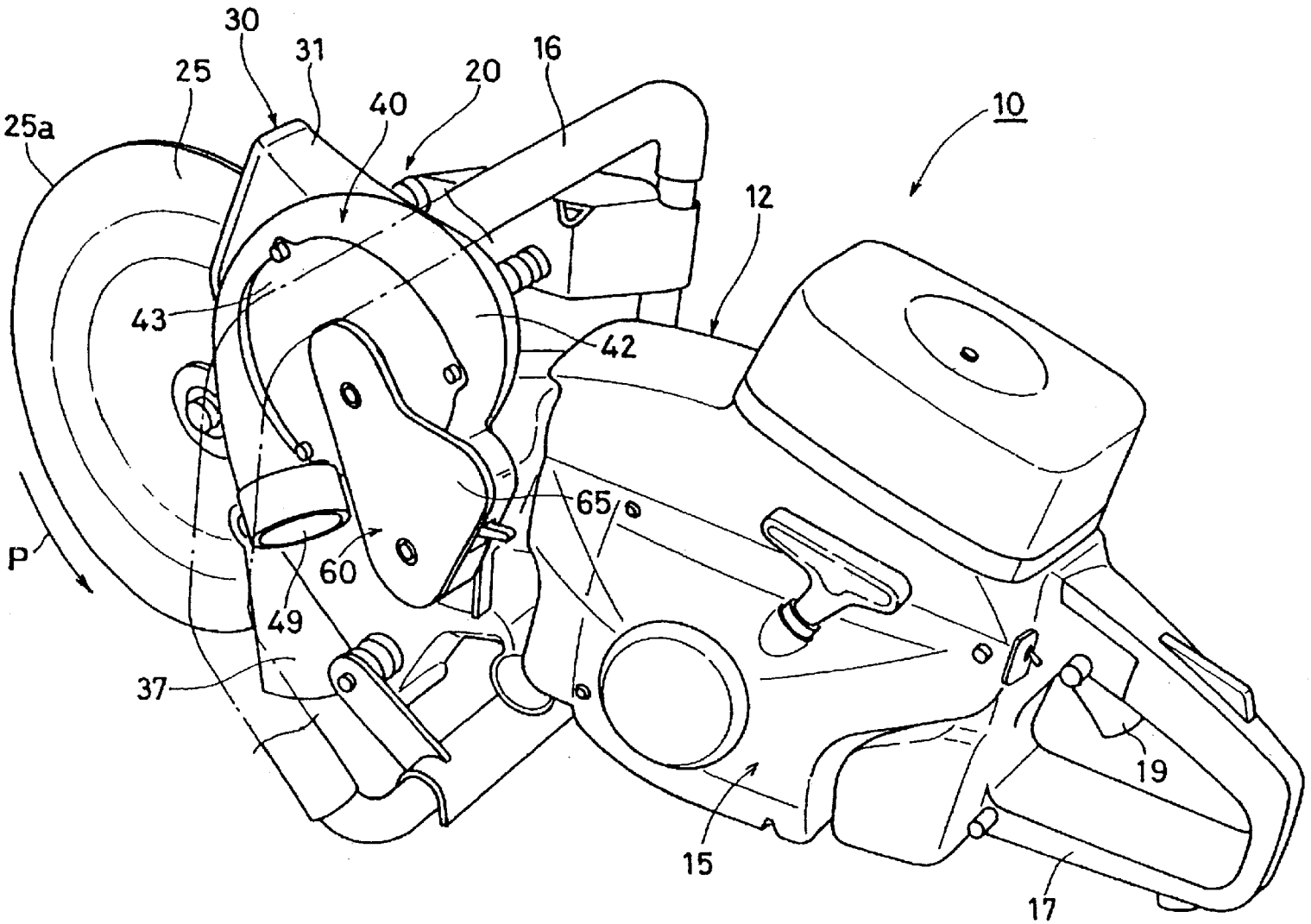
FIG. 10 shows a power cutter. by Husqvarna AB.

FIG. 10 shows a power cutter. The power cutter has a housing and a handle for a user to hold the power cutter. The power cutter has a circular blade that extends out from the housing. The circular blade is rotated to cut objects such as dry wall. An engine, such as the type described herein, can be disposed in the housing and configured to provide power to move the circular blade. FIG. 10 corresponds to the figure numbered "1" in U.S. Pat. No. 6,155,246, issued on Dec. 5, 2000. The reference numerals are listed and the figure described in U.S. Pat. No. 6,155,246, which is incorporated by reference herein.

Figure 1:
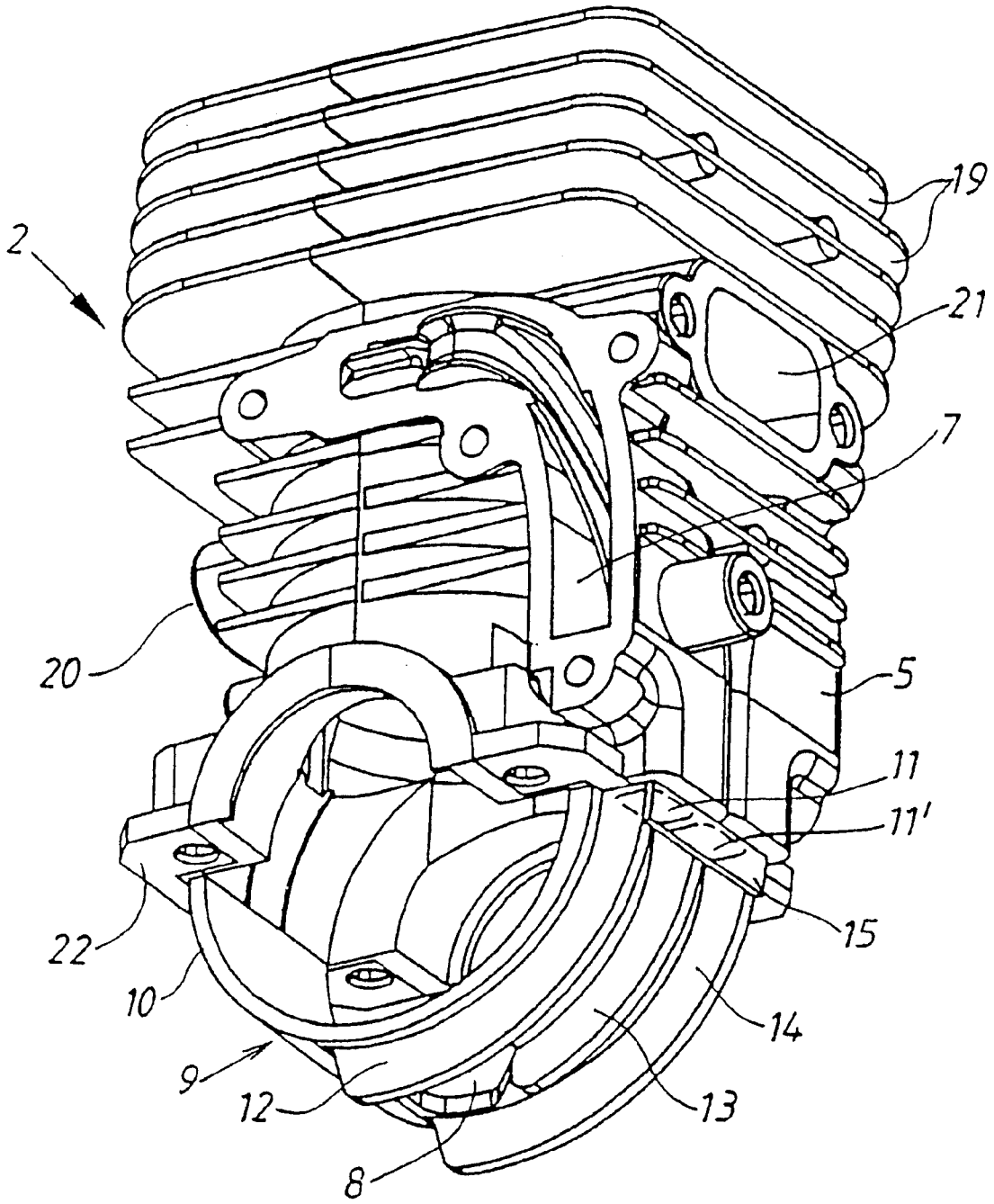
FIG. 1 shows in perspective, obliquely from below an engine body with a horizontally-split crankcase. For the sake of clarity the bottom crankcase half is not shown. Hereby the crankcase insert becomes clearly apparent.

In FIG. 1 numeral reference 2 designates an engine body of an internal combustion engine. The engine body is not shown complete since the crankcase body 3 is missing for the sake of clarity. This becomes however apparent from FIGS. 2 and 3. The engine body 2 has a so called horizontally-split crankcase with parting plane 22. This is forming a parting plane between the engine crankcase body 3 and cylinder body 5, which are screwed together with screws through holes in each flange meeting in the parting plane 22, in the conventional way. The cylinder body 5 is provided with an inlet 20 for air/fuel mixture, an exhaust gas outlet 21 for exhaust gases as well as the top half of the crankcase. Furthermore the cylinder body has a number of cooling fins 19. It has also two scavenging ducts 7, 7', where the latter is located on the back of the body and is therefore hidden. The scavenging duct 7 is partly arranged in a lid 26, which is fastened with screws onto the cylinder body. The lids 25 and 25' become apparent from FIG. 3. The scavenging ducts 7 and 7' could as well be cast altogether in the cylinder body 5. In this case the lids 26 and 26' are thus missing. For, the characteristic feature of the invention is the embodiment of the crankcase.

Figure 2:
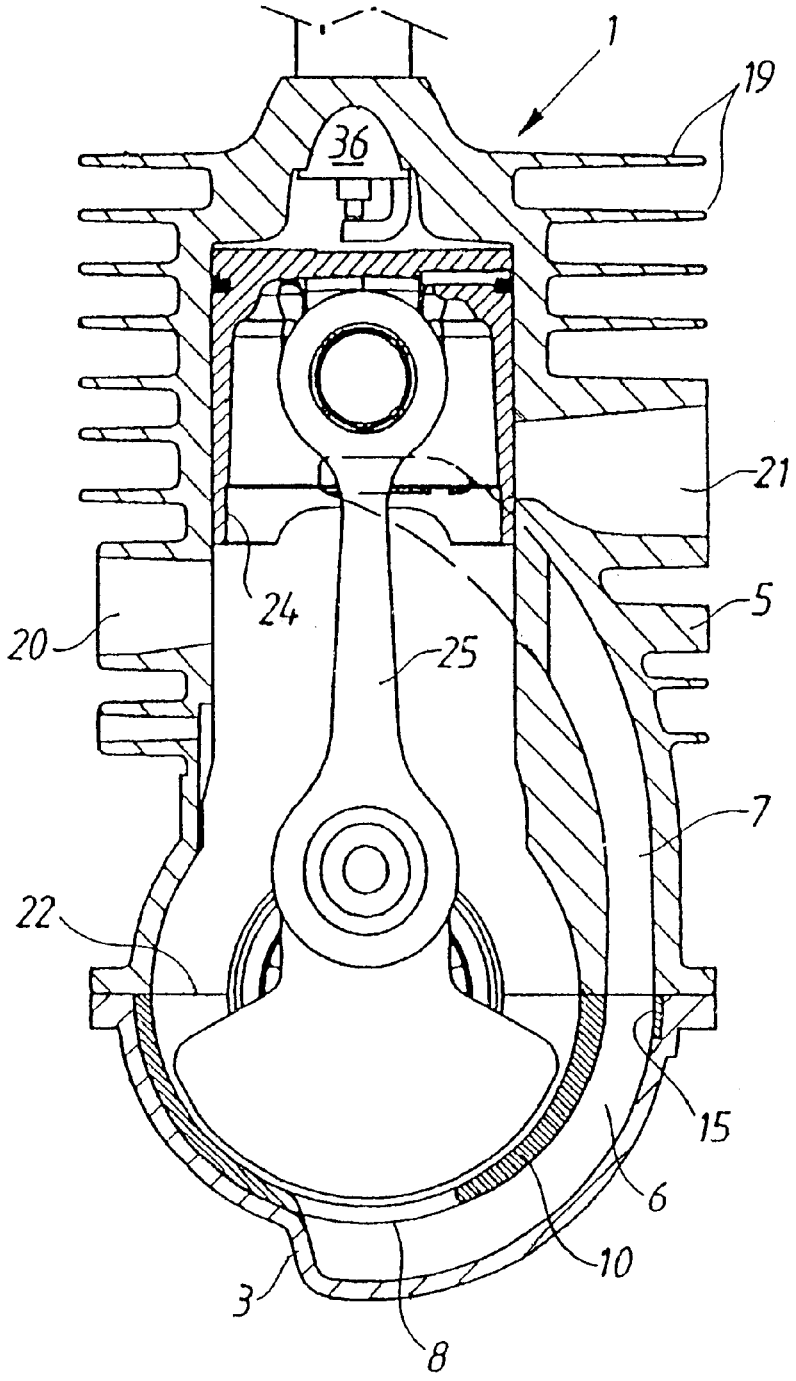
FIG. 2 shows in a cross-sectional view and seen from the direction of the crankshaft the engine body in accordance with FIG. 1, but here provided with the bottom crankcase half, piston and crank mechanism.
Figure 3:
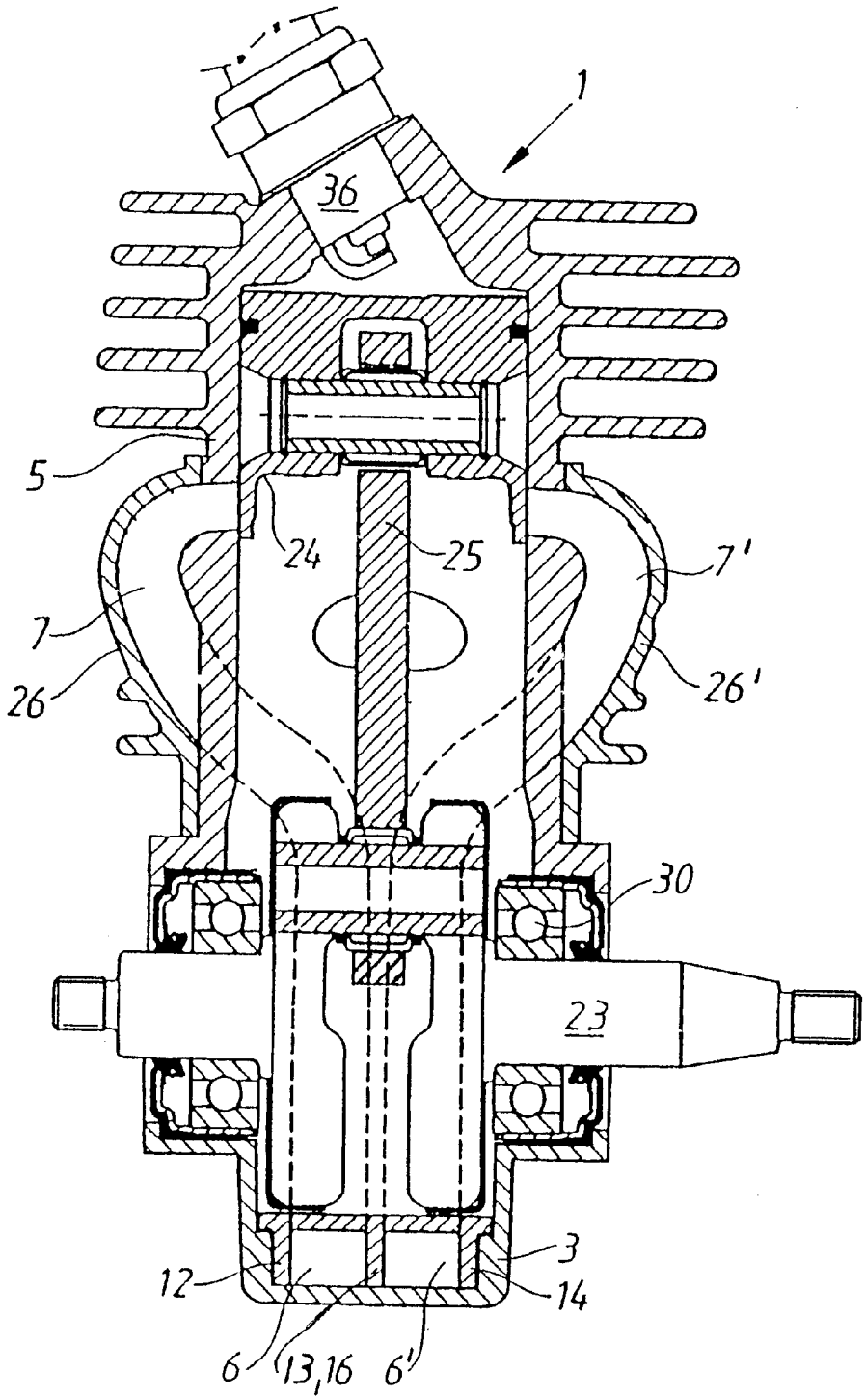
FIG. 3 shows the engine body according to FIG. 2 in cross-section, but seen from the side perpendicularly from the direction of the crankshaft.

The horizontally-split crankcase 3 is not shown in FIG. 1, but on the other hand the insert part 9 is, which is located in the crankcase (compare with FIGS. 2 and 3). The insert part 9 comprises at least one inner wall 10 facing the crankshaft assembly and provided with its inlet 8. Through this inlet scavenging gases flow into one or two scavenging ducts in the crankcase part. In the shown example the inner wall 10 follows the crankcase body 3 over its entire length, i.e. from the one side of the parting plane 22 to the other side of the parting plane 22. In this manner the insert part 9 is clamped between both of the engine body parts 3, 5 and will therefore be kept fixed in a simple way. This also contributes to a satisfactory sealing round the scavenging duct 6, 6' in the parting plane 22 at the one side, in this case the right side, compare FIG. 1 and 2. But obviously the insert part can also be fastened in other ways into the crankcase body 3 and can even have a smaller extension angle than the shown maximal one.

As becomes apparent from FIGS. 1 and 3 the insert part 9 has three side walls 12, 13, 14. The three side walls separate two scavenging ducts 6, 6'. Each of them leads from the inlet 8 up to an outlet 11, 11', where they connect to each cylinder part 7, 7' of the scavenging ducts respectively. Closest to each outlet 11, 11' the insert part 9 also has an outer wall 15, 15' opposite the inner wall 10. This outer wall is here arranged locally in order to improve the sealing in the parting plane 22. But it could also extend much longer, e.g. right up to the beginning of the side walls 12 and 14. In this case two absolutely tight scavenging ducts within the insert part are created, which can be an advantage. For, the shown example is based on that the insert part 9 in combination with the inner side of the crankcase body is forming both of the scavenging ducts 6, 6'. Obviously this could lead to a certain leakage where the side walls 12, 13, 14 meet with the inner side of the crankcase part 3.

The insert part does not need to have three side walls but could as well have fewer side walls. It is however preferable that the insert part, apart from the inner wall 10, has at least one side wall 12, 13, 14, which connects to the inner side of the crankcase body, e.g. it could as well have a side wall 13 located at or adjacent the middle of the inner wall 10, so that the insert part in a sectional view will get a T-shaped look, and the side wall 13 separates a scavenging duct on each side of it. This becomes apparent by removing the side walls 12 and 14 in FIG. 3. A sealing will then take place between the inner wall 10 and the inner side surfaces of the crankcase part. The same result would also be achieved if the side wall 13 instead should be fastened to the crankcase part 3. In that case the insert part 9 would be completely without side walls but would on the other hand co-operate with at least one wall 16 arising from the inner side of the crankcase body, so that at least two scavenging ducts are being separated. The wall 16 should then preferably be cast in the crankcase part 3 and have an adapted height so that it reaches exactly up to the inner wall 10 of the insert part. Obviously, also this middle wall could be arranged both in the insert part and in the crankcase part, e.g. a side wall 13 of the insert part could protrude down between two rising walls 16, 16' in the crankcase part. Hereby a sort of labyrinth seal between these walls would be created, and the length of the walls could be reduced somewhat, which is advantageous.

The dividing up into two scavenging ducts could also take place first at the transfer to the cylinder body 5. In this case no inner wall 13, 16, which separates both of the scavenging ducts in the crankcase body 3, would be needed. As earlier mentioned the insert part 9 can have only one inner wall 10 and thereby separate only one scavenging duct in the crankcase body 3. But obviously the insert part can have two side walls 12, 14 located at or adjacent each outer sides of the inner wall 10, so that the side walls will separate a scavenging duct between them. In case the insert part 9 also has an outer wall 15, which connects the inner walls 12, 14, a scavenging duct will be created within the insert part. This will reduce the risk of leaking.

In FIGS. 2 and 3 also the engine's piston 24, piston rod 25, crankshaft 23 with crankshaft bearing 30 and conventional crank mechanism is shown. All this is conventional and will therefore not be connected upon or discussed any further.

Figure 4:
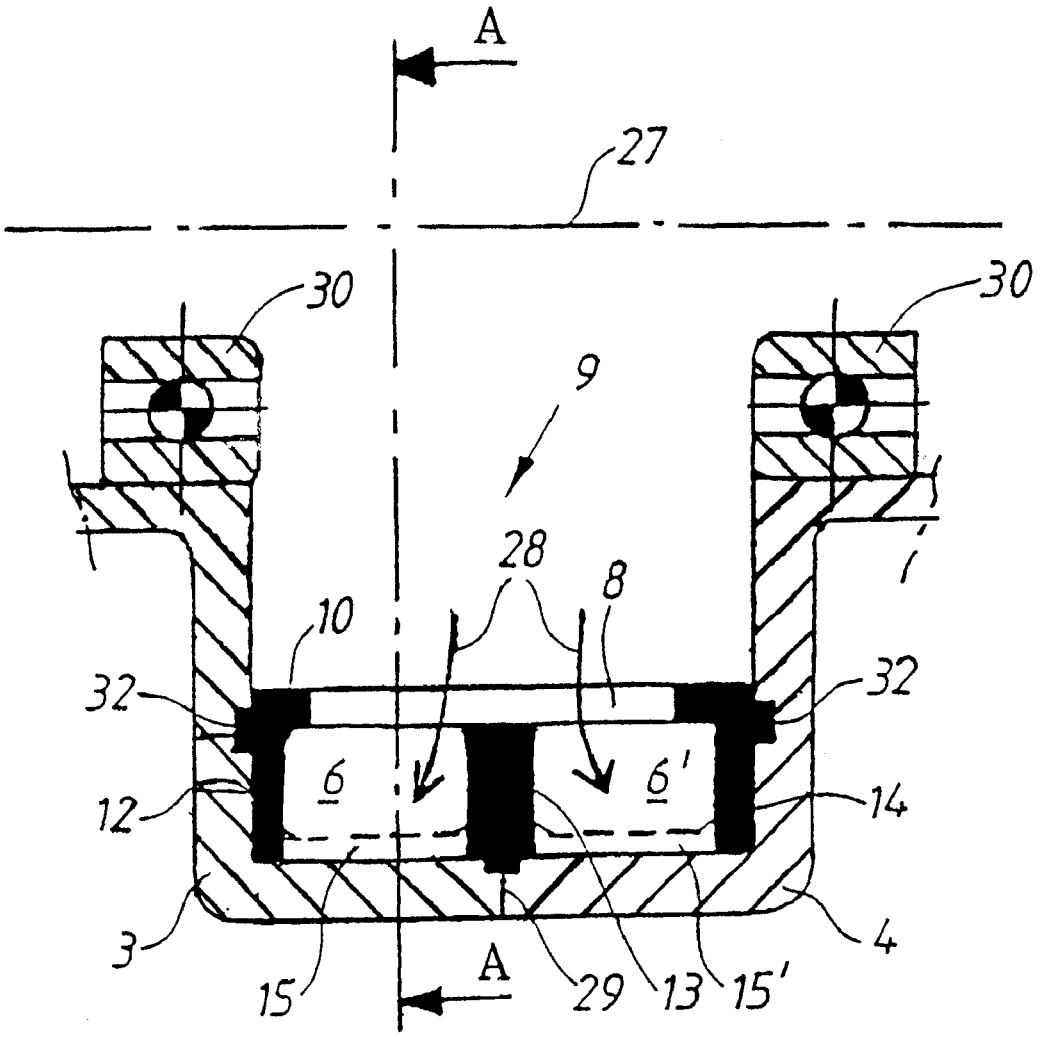
FIG. 4 shows a vertical cross-sectional view through a vertically-split crankcase. For the sake of clarity the cross-section is cut along the center axis of the crankshaft and hereby this axis and the crankshaft bearings are clearly shown. The insert part with the scavenging duct inlet becomes evidently visible.
Figure 5:
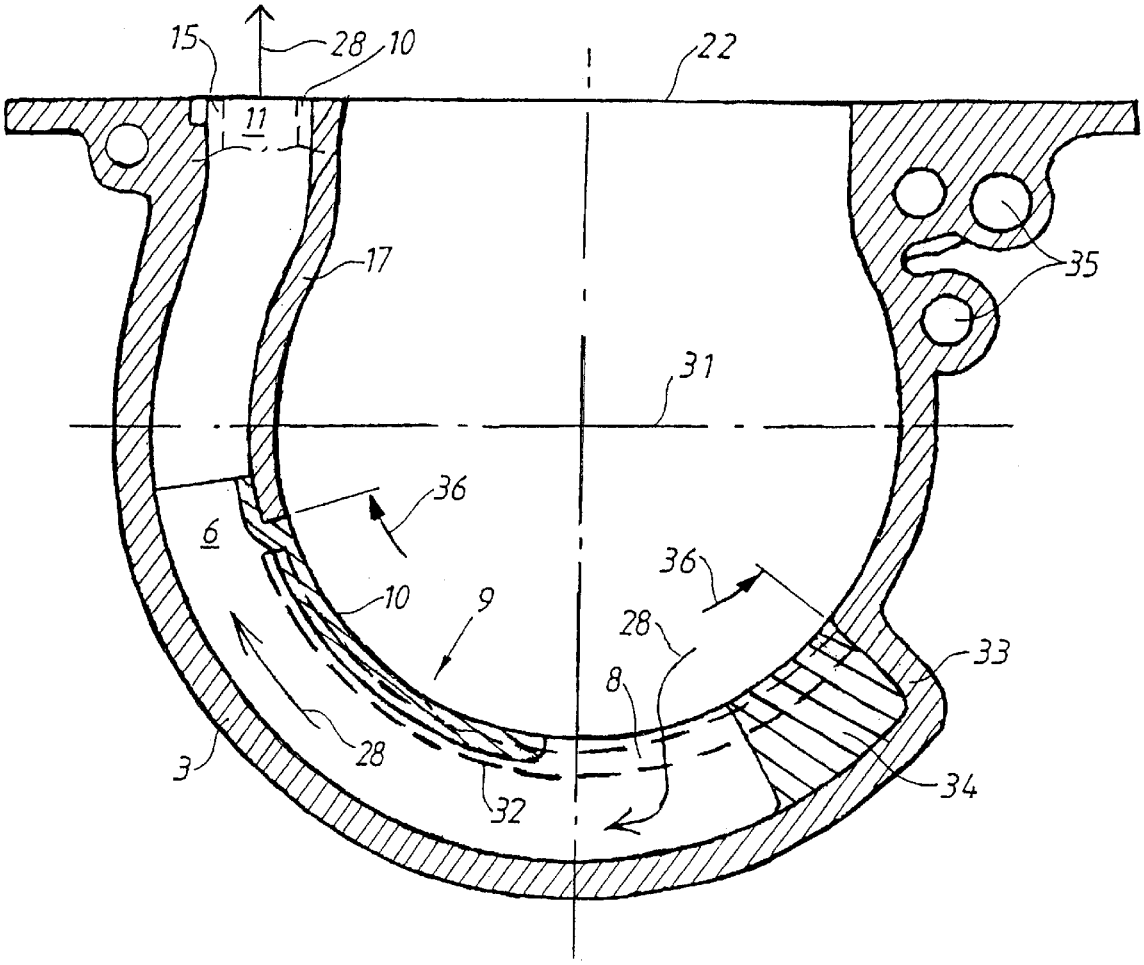
FIG. 5 shows a cross-section through the crankcase and the insert according to A—A in FIG. 4.

FIGS. 4 and 5 are showing a vertically-split crankcase 3, 4 with an inserted part 9. The parting plane 22 between both of the crankcase bodies 3, 4 and the cylinder body 5 is here lying considerably higher than in the earlier embodiment with a horizontally-split crankcase. The center axis 27, which shows the crankshaft's position in FIG. 4, has a height position that becomes apparent from the center axis 31 of the crankcase. Compared to the earlier embodiment the parting plane 22 has thus been moved up from the centre axis 31. Both of the crankcase parts 3 and 4 will meet in the vertical parting plane 29. They are screwed together by means of screws through a number of screw holes 35. Each crankcase part 3, 4 has its own crankshaft bearing 30 located entirely in itself. All this is conventional and will not be further discussed. Since the crankcase body comprises two parts, 3 and 4, the insert part can be mounted into the crankcase in more ways than in the earlier embodiment The insert part 9 is here provided with laterally protruding collars or pins 32. These protrude into cast grooves or possibly local recesses. When the crankcase parts 3 and 4 are joined together the insert part 9 is thus kept fixed. However, the insert part could also extend right up to the parting plane 22 on both sides and be kept fixed in the same way as in the earlier embodiment. Obviously the insert part could also be anchored by screwing or gluing in one or both of the crankcase parts. Referring to the earlier embodiment, what was said about the design of the insert part 9 regarding the inner wall and side walls is valid to the same extent also in this case. It can thus comprise only one inner wall 10 and this can separate one or two scavenging ducts. In the latter case the rising wall 16 is replaced by a wall which is clamped up in the parting plane 29. The insert part 9 can thus have a number of side walls 12, 13, 14 and possible outer walls 15, 15' exactly as in the earlier embodiment.

However, in this case the insert part 9 can co-operate with a scavenging duct, which is cast into the crankcase. This becomes evident from FIG. 5. The inner side of the crankcase body is here arranged with an extra inner side 17 arranged from the parting plane 22 of the engine and a distance downwards in the crankcase. A cavity on both sides of tile parting plane 29 is here created, so that a cast scavenging duct will exist inside the extra inner side 17. The insert part 9 can connect to the cast scavenging duct in many different ways. In the example in FIG. 5 is shown how the inner wall 10 of the insert part locally is adapted and slightly overlapping the inner side 17. The same is valid for one or several side walls. The side walls and a possible inner wall 10 and/or outer wall 15 can also be lead all the way up to the parting plane 22. This is suggested by the dash-dotted lines up at the parting plane and is thus a conceivable embodiment. The cast part of the scavenging duct 6 contributes to stiffening the crankcase and can thereby be advantageous. However, as mentioned the insert part can also extend right up to the parting plane 22 so that no cast scavenging duct in the crankcase part would be needed.

A big advantage with the insert part 9 is that it contains the inlet 8 of the scavenging duct. In FIG. 5 is marked by arrows 36 the whole extension within which the inlet 8, with the aid of different insert parts 9, can be located in this case. This range of variation implies a substantial advantage compared with an entirely cast scavenging duct. The crankshaft angle, which corresponds to the extension of the arrows 36, should be at least 90°, preferably 120°. From FIG. 5 it becomes apparent how the scavenging gases 28 are flowing through the inlet 8 and following the scavenging duct 6 up to the outlet 11 at the parting plane 22. A filling 34 of the scavenging ducts 6, 6' is arranged adjacent the one side of the inlet 8. For, in this case the maximum possible length of the scavenging duct is not being used. A cross wall in the insert part 9 would also be possible but could result in a certain leakage.

To further explain, the crankcase angle, which corresponds to the extension of the arrows 36, should be at least 90°, preferably 120°. The crankcase angle can be designed to accommodate various crankshafts, pistons, and counterweights depending on the desired engine characteristics, as discussed previously.

Consequently, by changing the insert part the length of the scavenging duct can thus be changed. But also its area can be changed. This is achieved by varying the thickness and/or position of the different walls of the insert part, i.e. the inner wall 10, the side walls-12, 13, 14 and possibly the outer walls 15, 15'. This is valid for all embodiments described.

In a case where the insert part 9 is covering a great deal of the inner surface of the crankcase, the inner dimension of the insert part would definitely affect the volume of the crankcase, so that an adaptation of the crankcase for engines with different cylinder strokes can be made. In that case the insert part could contribute to that a crankcase can be used for a number of similar engines without having unnecessary large crankcase volume for some of the engines. The insert part 9 is preferably produced of a plastic material with sufficient heat resistance, such as polyamide. Obviously it could also be produced from metal, such as aluminum or magnesium.

In FIG. 5, the crankcase body 3 has a wall portion 33 located adjacent the filling 34. In FIGS. 2 and 3, a spark plug 136 is shown.

FIG. 11 shows a chain saw, model no. 340, manufactured by Husqvarna AB. This example was found on the Husqvarna AB internet web site, "http://international.husqvarna.com".

FIG. 12 shows a weed trimmer, model no. 232L, manufactured by Husqvarna AB. This example was also found on the Husqvarna AB internet web site, "http://international.husqvarna.com".

FIG. 13 shows a power cutter, model no. 371K, manufactured by Husqvarna AB. This example was also found on the Husqvarna AB internet web site, "http://international.husqvarna.com".

One feature of the invention resides broadly in a crankcase scavenged internal combustion engine (1) mainly intended for a handheld working tool, such as a chain saw, with an engine body (2) composed of at least one crankcase body (3, 4) and a cylinder body (5), which are joined together, and the engine is provided with so called elongated scavenging ducts (6,7,6',7'), which over some part of their length i.e. a crankcase part (6,6'), extend in the crankcase body (3,4) and have their inlet (8) there, and over another part of their length, i.e. a cylinder part (7,7'), extend in the cylinder body (5), characterized in that the crankcase part (6,6') of at least one scavenging duct to a great extent is composed of an insert part (9) with at least one inner wall (10) facing the crankshaft assembly and provided with the inlet (8), so that the crankcase part (6,6') of the scavenging duct is composed of the insert part (9) alone or in combination with the inner side of the crankcase body and leads from the inlet (8) to an outlet (11, 11') intended to connect to the cylinder part (7,7') of the scavenging duct.

Another feature of the invention resides broadly in a crankcase scavenged internal combustion engine (1) characterized in that the insert part (9), apart from the inner wall (10), has at least one side wall (12, 13, 14), which connects to the inner wall (10) and to the inner side of the crankcase body (3,4).

Yet another feature of the invention resides broadly in a crankcase scavenged internal combustion engine (1) characterized in that the insert part (9) has a side wall (13) located at or adjacent the middle of the inner wall (10), so that the insert part in a sectional view will get a T-shaped look, and the side wall (13) separates a scavenging duct on each side of it.

Still another feature of the invention resides broadly in a crankcase scavenged internal combustion engine (1) characterized in that the insert part (9) has two side walls (12,14) located at or adjacent each of the outer sides of the inner wall (10), so that the side walls (12,14) will separate a scavenging duct between them.

A further feature of the invention resides broadly in a crankcase scavenged internal combustion engine (1) characterized in that the insert part (9) has yet another side wall (13) located at or adjacent the middle of the inner wall (10), so that the side walls (12, 13, 14) will separate two scavenging ducts.

Another feature of the invention resides broadly in a crankcase scavenged internal combustion engine (1) characterized in that the insert part (9) also has an outer wall (15,15') opposite to the inner wall (10).

Yet another feature of the invention resides broadly in a crankcase scavenged internal combustion engine (1) characterized in that the insert part (9) co-operates with at least one wall (16, 16') rising from the inner side of the crankcase body, so that at least two scavenging ducts are being separated.

Still another feature of the invention resides broadly in a crankcase scavenged internal combustion engine (1) characterized in that the engine body (2) is composed of one crankcase body (3), in which the insert part (9) is located, and a cylinder body (5).

A further feature of the invention resides broadly in a crankcase scavenged internal combustion engine (1) characterized in that the engine body (2) is composed of two crankcase bodies (3,4), between which the insert part (9) is located, and a cylinder body (5).

Another feature of the invention resides broadly in a crankcase scavenged internal combustion engine (1) characterized in that the inner side of the crankcase body is arranged with an extra inner side (17) arranged from the parting plane (22) of the engine towards the cylinder body (5) and a distance downwards into the crankcase in order to at least at its end in the crankcase co-operate with the insert part (9), so that they together form the crankcase part (6, 6') of at least one scavenging duct.

Yet another feature of the invention resides broadly in a crankcase scavenged internal combustion engine, mainly intended for a handheld working tool, such as a chain saw, with an engine body (2) composed of at least one crankcase body (3, 4) and a cylinder body (5), which are joined together, and the engine is equipped with so called elongated scavenging ducts (6, 7, 6', 7'), which over some part of their length, i. e. a crankcase part (6, 6'), extend in the crankcase body (3, 4) and have their inlet (8) there, and over another part of their length, i.e. a cylinder part (7, 7'), extend in the cylinder body (5). For the sake of clarity the crankcase body (3) is not shown, however an insert part (9) is, which together with the inner side of the crankcase body (3) is forming the crankcase parts (6, 6') of the scavenging ducts. In the shown example the duct (6) is separated by side walls (12, 13), an inner wall (10) as well as the inner side of the crankcase body. Generally this means that the crankcase part (6, 6') of at least one scavenging duct to a great extent is composed of an insert part (9) with at least one inner wall (10) facing the crankshaft assembly and provided with the inlet (8), so that the crankcase part (6, 6') of the scavenging duct is composed of the insert part (9) alone or in combination with the inner side of the crankcase body, and leads from the inlet (8) to an outlet (11, 11') intended to connect to the cylinder part (7, 7') of the scavenging duct.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following U.S. patents which are cited on the corresponding international search report dated Jan. 21, 2000, are hereby incorporated by reference as if set forth in their entirety herein: U.S. Pat. Nos. 4,213,431, issued on Jul. 22, 1980 to inventor Onishi; No. 4,204,489, issued on May 27, 1980 to inventor Onishi; No. 4,204,488, issued on May 27, 1980 to inventor Onishi; No. 1,353,465, issued on Sep. 21, 1920 to inventor Edwards; and No. 1,360,383, issued on Nov. 30, 1920 to inventor Edwards.

The corresponding foreign and international patent publication applications, namely, International Application No. PCT/SE99/01961, filed on Nov. 1, 1999 and having WIPO publication No. WO 00/26516, and Swedish Patent Application No. 9803752-6, filed on Nov. 4, 1998, having inventors Bo JONSSON and Mats SVENSSON, as well as Laid-Open Swedish Patent Application No. 9803752-6 and Published Swedish Patent Application No. 9803752-6, as well as their published equivalents, and other equivalents or corresponding applications, if any, in corresponding cases in Sweden and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Some examples of chain saws that may possibly be utilized or adapted for use in at least one embodiment of the present invention may be found in the following U.S. Pat. Nos. 3,938,306, issued on Feb. 10, 1976 to inventors Naslund et al.; No. 6,148,525, issued on Nov. 21, 2000 to inventors Mizutani et al.; No. 6,148,524, issued on Nov. 21, 2000 to inventor Nitschmann; No. Des. 389,026, issued on Jan. 13, 1998 to inventors Amano et al.; No. 5,497,557, issued on Mar. 12, 1996 to inventor Martinsson; No. 4,393.589, issued on Jul. 19, 1983 to inventor Barkhult; No. 5,142,934, issued on Sep. 1, 1992 to inventors Persson et al.; No. 5,070,618, issued on Dec. 10, 1991 to inventor Edlund; No. 4,920,649, issued on May 1, 1990 to inventors Ström et al.; No. 4,765,062, issued on Aug. 23, 1988 to inventor Henriksson; and No. 4,773,365, issued on Sep. 27, 1988 to inventor Nagashima.

Some examples of hedge or weed trimmers that may possibly be utilized or adapted for use in at least one embodiment of the present invention may be found in the following U.S. Pat. Nos. 6,158,636, issued on Dec. 12, 2000; No. 5,778,649, issued on Jul. 14, 1998 to inventors Losdahl et al.; No. 5,653,030, issued on Aug. 5, 1997 to inventors Yokoyama et al.; No. 5,581,891, issued on Dec. 10, 1996 to inventors Wheeler et al.; No. 4,216,582, issued on Aug. 12, 1980 to inventors Paule et al.; and Des. No. 377,742, issued on Feb. 4, 1997 to inventors Losdahl et al.

Some examples of power cutters that may possibly be utilized or adapted for use in at least one embodiment of the present invention may be found in the following U.S. Pat. Nos. 6,155,246, issued on Dec. 5, 2000 to inventors Yamami, et al.; No. 6,014,811, issued on Jan. 18, 2000 to inventors Taomo, et al.; No. 6,047,693, issued on Apr. 11, 2000 to inventors Yamami, et al.; No. 6,039,037, issued on Mar. 21, 2000 to inventors Taomo, et al.; No. 6,014,811, issued on Jan. 18, 2000 to inventors Taomo, et al.; No. 4,996,773, issued on Mar. 5, 1991 to inventor Albertson; and No. 4,924,571, issued on May 15, 1990 to inventor Albertson.

Some examples of polytetrafluoroethylene or PTFE or teflon that may possibly be utilized or adapted for use in at least one embodiment of the present invention may be found in the following U.S. Pat. Nos. No. 5,403,437, issued on Apr. 4, 1995 to inventors Beratan et al.; No. 6,203,735 B1, issued on Mar. 20, 2001 to inventors Edwin et al.; No. 6,177,533 B1, issued on Jan. 23, 2001 to inventor Woodward; No. 6,162,885, issued on Dec. 19, 2000 to inventor Ruefer; No. 6,100,318, issued on Aug. 8, 2000 to inventor Zipplies; No. 6,080,472, issued on Jun. 27, 2000 to inventors Huang et al.; No. 6,054,083, issued on Apr. 25, 2000 to inventors Asano et al.; No. 6,030,428, issued on Feb. 29, 2000 to inventors Ishino et al.; No. 6,025,441, issued on Feb. 15, 2000 to inventors Koshirai et al.; No. 5,994,499, issued on Nov. 30, 1999 to inventors Asano et al.; No. 5,763,082, issued on Jun. 9, 1998 to inventors Kokumai et al.; No. 5,762,846, issued on Jun. 9, 1998 to inventors Blankenbeckler et al.; No. 5,723,081, issued on Mar. 3, 1998 to inventors Blankenbeckler et al.; No. 5,721,283, issued on Feb. 24, 1998 to inventors Howard, Jr. et al.; No. 5,700,572, issued on Dec. 23, 1997 to inventors Klatt et al.; No. 5,688,836, issued on Nov. 18, 1997 to inventors Yamamoto et al.; No. 5,686,033, issued on Nov. 11, 1997 to inventor Shimizu; No. 5,677,047, issued on Oct. 14, 1997 to inventor Thomas; No. 5,514,231, issued on May 7, 1996 to inventor Thomas; No. 5,512,624, issued on Apr. 30, 1996 to inventors Howard, Jr. et al.; No. 5,418,054, issued on May 23, 1995 to inventor Sun; No. 5,198,053, issued on Mar. 30, 1993 to inventor Duncan; No. 5,110,526, issued on May 5, 1992 to inventors Hayashi et al.; No. 5,102,921, issued on Apr. 7, 1992 to inventors Harada et al.; and No. 4,710,331, issued on Dec. 1, 1987 to inventors Nobuo et al.

Some examples of temperature-resistant plastics or plastics for use with fuel, such as in engines or fuel tanks, that may possibly be utilized or adapted for use in at least one embodiment of the present invention may be found in the following U.S. Pat. Nos. 6,003,904, issued on Dec. 21, 1999 to inventors Frölich et al.; No. 5,511,964, issued on Apr. 30, 1996 to inventors Hegler et al.; No. 5,727,791, issued on Mar. 17, 1998 to inventors Weiss et al.; No. 5,575,249, issued on Nov. 19, 1996 to inventors Mielke et al.; No. 5,727,791, issued on Mar. 17, 1998 to inventors Weiss et al.; No. 5,503,872, issued on Apr. 2, 1996 to inventors MacKenzie et al.; and No. 3,996,142, issued on Dec. 7, 1976 to inventors White et al.

Some examples of two-stroke and/or two-cycle engines that may possibly be utilized or adapted for use in at least one embodiment of the present invention may be found in the following U.S. Pat. Nos. 5,983,846, issue on Nov. 16, 1999 to inventor Klöpfer; No. 6,182,619 B1, issued on Feb. 6, 2001 to inventors Spitzer et al.; No. 6,173,683 B1, issued on Jan. 16, 2001 to inventors Nemoto et al.; No. 6,135,071, issued on Oct. 24, 2000 to inventors Kobayashi et al.; No. 6,089,195, issued on Jul. 18, 2000 to inventor Lowi, Jr.; No. Re. 36,451, reissued on Dec. 21, 1999 to inventors Gillespie et al.; No. 5,884,590, issued on Mar. 23, 1999 to inventor Minculescu; No. 5,881,687, issued on Mar. 16, 1999 to inventor Sakaguchi et al.; No. 5,343,839, issued on Sep. 6, 1994 to inventors Baika et al.; No. 5,271,362, issued on Dec. 21, 1993 to inventors Kobayashi et al.; No. 5,201,286, issued on Apr. 13, 1993 to inventor Kerrigan; No. 5,140,958, issued on Aug. 25, 1992 to inventors Kobayashi et al.; No. 5,136,989, issued on Aug. 11, 1992 to inventors Sterbenz et al.; No. 5,125,380, issued on Jun. 30, 1992 to inventors Nakae et al.; No. 5,063,886, issued on Nov. 12, 1991 to inventors Kanamaru et al.; and No. 5,050,384, issued on Sep. 24, 1991 to inventor Crockett Some examples of magnesium alloys and/or casting of magnesium alloys, heat-resistant magnesium alloys, and/or magnesium alloys containing aluminum that may possibly be utilized or adapted for use in at least one embodiment of the present invention may be found in the following U.S. Pat. Nos. No. 6,146,584, issued on Nov. 14, 2000 to inventors Park et al.; No. 6,143,097, issued on Nov. 7, 2000 to inventors Fujita et al.; No. 6,139,651, issued on Oct. 31, 2000 to inventors Bronfin et al.; No. 6,056,834, issued on May 2, 2000 to inventors Kubota et al.; No. 5,855,697, issued on Jan. 5, 1999 to inventors Luo et al.; No. 5,811,058, issued on Sep. 22, 1998 to inventors Baba et al.; No. 5,681,403, issued on Oct. 28, 1997 to inventors Makino et al.; No. 5,676,774, issued on Oct. 14, 1997 to inventors Setzer et al.; No. 5,593,516, issued on Jan. 14, 1997 to inventor Cassada, III; No. 5,552,110, issued on Sep. 3, 1996 to inventors Iba et al.; No. 5,512,112, issued on Apr. 30, 1996 to inventor Cassada, III; No. 5,512,112, issued on Apr. 30, 1996 to inventor Cassada, III; No. 5,167,917, issued on Dec. 1, 1992 to inventor Sugitani; No. 4,886,557, issued on Dec. 12, 1989 to inventor Chadwick; No. 4,579,166, issued on Apr. 1, 1986 to inventors Neelameggham et al.; No. 3,947,268, issued on Mar. 30, 1976 to inventors Tikhonova et al.; and No. 3,930,895, issued on Jan. 6, 1976 to inventors Moser et al.

Some examples of aluminum alloys and/or casting of aluminum alloys and heat-resistant aluminum alloys that may possibly be utilized or adapted for use in at least one embodiment of the present invention may be found in the following U.S. Pat. Nos. 6,168,675 Bi, issued on Jan. 2, 2001 to inventors Fang et al.; No. Re. 36,692, reissued on May 16, 2000 to inventors Gupta et al.; No. 6,165,291, issued on Dec. 26, 2000 to inventors Jin et al.; No. 6,073,678, issued on Jun. 13, 2000 to inventors Garza-Ondarza et al.; No. 5,961,752, issued on Oct. 5, 1999 to inventor Bergsma; No. 5,846,348, issued on Dec. 8, 1998 to inventors Sakoda et al.; No. 5,778,962, issued on Jul. 14, 1998 to inventors Garza-Ondarza et al.; No. 5,298,094, issued on Mar. 29, 1994 to inventors Ota et al.; No. 5,211,778, issued on May 18, 1993 to inventors Sasaki et al.; No. 5,120,372, issued on Jun. 9, 1992 to inventors Yen et al.; No. 5,110,545, issued on May 5, 1992 to inventors McAuliffe et al.; No. 4,973,363, issued on Nov. 27, 1990 to inventors Hayato et al.; No. 4,909,858, issued on Mar. 20, 1990 to inventor Reiso; No. 4,806,307, issued on Feb. 21, 1989 to inventors Hirose et al.; No. 4,786,340, issued on Nov. 22, 1988 to inventors Ogawa et al.; No. 4,751,958, issued on Jun. 21, 1988 to inventors Flowers et al.; No. 4,462,961, issued on Jul. 31, 1984 to inventors Ito et al.; No. 4,402,763, issued on Sep. 6, 1983 to inventors Sato et al.; No. 4,038,072, issued on Jul. 26, 1977 to inventors Kolobnev et al.; No. 4,832,737, issued on May 23, 1989 to inventors Mathy et al.; and No. 4,896,815, issued on Jan. 30, 1990 to inventors Rosenthal et al.

Some examples of vertically-split and horizontally-split crankcases that may possibly be utilized or adapted for use in at least one embodiment of the present invention may be found in the following U.S. Pat. Nos. 6,105,548, issued on Aug. 22, 2000 to inventors Carlson et al.; No. 5,495,833, issued on Mar. 5, 1996 to inventors Ishizaka et al.; No. 4,913,112, issued on Apr. 3, 1990 to inventor Iida; and No. 4,763,619, issued on Aug. 16, 1988 to inventor Eitel.

The following internet or world wide web (WWW) web sites, pages, sub pages, associated web sites, and pages linked to from these pages, as well as the information contained and/or published or posted therein, for DSM and Husqvarna AB are hereby incorporated by reference as if set forth in their entirety herein as follows: "http://www.dsm.dl" for DSM and "http://international.husqvarna.com" for Husqvarna AB.

The invention as described hereinabove in the context of the preferred embodiments is not to be taken as limited to all of the provided details thereof, since modifications and variations thereof may be made without departing from the spirit and scope of the invention.

What is claimed is:

1. A chain saw, said chain saw comprising a housing, a handle to permit holding of the chain saw, a blade connected to and extending from the housing, a chain disposed about the blade, an engine being disposed in the housing, the chain being operatively connected to the engine, the engine being configured to produce force to move the chain about the blade, and the engine being a crankcase scavenged internal combustion engine (1) with an engine body (2) composed of at least one crankcase body (3,4) and a cylinder body (5), which are joined together, and the engine is provided with so called elongated scavenging ducts (6,7,6', 7'), which over some part of their length i.e. a crankcase part (6,6'), extend in the crankcase body (3,4) and have their inlet (8) there, and over another part of their length, i.e. a cylinder part (7,7'), extend in the cylinder body (5), characterized in that the crankcase part (6,6') of at least one scavenging duct to a great extent is composed of an insert part (9) with at least one inner wall (10) facing the crankshaft assembly and provided with the inlet (8), so that the crankcase part (6,6') of the scavenging duct is composed of the insert part (9) alone or in combination with the inner side of the crankcase body and leads from the inlet (8) to an outlet (11, 11') intended to connect to the cylinder part (7,7') of the scavenging duct.

2. The chain saw according to claim 1, characterized in that the insert part (9), apart from the inner wall (10), has at least one side wall (12, 13, 14), which connects to the inner wall (10) and to the inner side of the crankcase body (3,4).

3. The chain saw according to claim 2, characterized in that the insert part (9) has a side wall (13) located at or adjacent the middle of the inner wall (10), so that the insert part in a sectional view will get a T-shaped look, and the side wall (13) separates a scavenging duct on each side of it.

4. The chain saw according to claim 2, characterized in that the insert part (9) has two side walls (12,14) located at or adjacent each of the outer sides of the inner wall (10), so that the side walls (12,14) will separate a scavenging duct between them.

5. The chain saw according to claim 4, characterized in that the insert part (9) has yet another side wall (13) located at or adjacent the middle of the inner wall (10), so that the side walls (12, 13, 14) will separate two scavenging ducts.

6. The chain saw in accordance with claim 2, characterized in that the insert part (9) also has an outer wall (15,15') opposite to the inner wall (10).

7. The chain saw according to claim 1, characterized in that the insert part (9) co-operates with at least one wall (16, 16') rising from the inner side of the crankcase body, so that at least two scavenging ducts are being separated.

8. The chain saw in accordance with claim 1, characterized in that the engine body (2) is composed of one crankcase body (3), in which the insert part (9) is located, and a cylinder body (5).

9. The chain saw in accordance with claim 1, characterized in that the engine body (2) is composed of two crankcase bodies (3,4), between which the insert part (9) is located, and a cylinder body (5).

10. The chain saw according to claim 9, characterized in that the inner side of the crankcase body is arranged with an extra inner side (17) arranged from the parting plane (22) of the engine towards the cylinder body (5) and a distance downwards into the crankcase in order to at least at its end in the crankcase co-operate with the insert part (9), so that they together form the crankcase part (6, 6') of at least one scavenging duct.

11. A handheld tool comprising one of: a chain saw, trimmer, or cutter, said handheld tool further comprising a housing, a handle to permit holding of the tool, a cutting mechanism connected to and extending from the housing, an engine being disposed in the housing, the cutting mechanism being operatively connected to the engine, the engine being configured to produce force to move the cutting mechanism, and the engine being a crankcase scavenged internal combustion engine with an engine body composed of at least one crankcase body and a cylinder body, which are joined together, and the engine is provided with so called elongated scavenging ducts, which over some part of their length i.e. a crankcase part, extend in the crankcase body and have their inlet there, and over another part of their length, i.e. a cylinder part, extend in the cylinder body, wherein the crankcase part of at least one scavenging duct to a great extent is composed of an insert part with at least one inner wall facing the crankshaft assembly and provided with the inlet, so that the crankcase part of the scavenging duct is composed of the insert part alone or in combination with the inner side of the crankcase body and leads from the inlet to an outlet intended to connect to the cylinder part of the scavenging duct.

12. The handheld tool according to claim 11, therein the insert part, apart from the inner wall, has at least one side wall, which connects to the inner wall and to the inner side of the crankcase body.

13. The handheld tool according to claim 12, wherein the insert part has a side wall located at or adjacent the middle of the inner wall, so that the insert part in a sectional view will get a T-shaped look, and the side wall separates a scavenging duct on each side of it.

14. The handheld tool according to claim 12, wherein the insert part has two side walls located at or adjacent each of the outer sides of the inner wall, so that the side walls will separate a scavenging duct between them.

15. The handheld tool according to claim 14, wherein the insert part has yet another side wall located at or adjacent the middle of the inner wall, so that the side walls will separate two scavenging ducts.

16. The handheld tool in accordance with claim 12, wherein the insert part also has an outer wall opposite to the inner wall.

17. The handheld tool according to claim 11, wherein the insert part co-operates with at least on wall rising from the inner side of the crankcase body, so that at least two scavenging ducts are being separated.

18. The handheld tool in accordance with claim 11, wherein the engine body is composed of one crankcase body, in which the inset part is located, and a cylinder body.

19. The handheld tool in accordance with claim 11, wherein the engine body is composed of two crankcase bodies, between which the insert part is located, and a cylinder body, and the inner side of the crankcase body is arranged with an extra inner side arranged from the parting plane of the engine towards the cylinder body and a distance downwards into the crankcase in order to at least at its end in the crankcase co-operate with the insert part, so that they together form the crankcase part of at least one scavenging duct.

20. A method for producing a handheld tool, said handheld tool comprising one of: a chain saw, trimmer, or cutter, said handheld tool further comprising a housing, a handle to permit holding of the tool, a cutting mechanism connected to and extending from the housing, an engine being disposed in the housing, the cutting mechanism being operatively connected to the engine, the engine being configured to produce force to move the cutting mechanism, and the engine being a crankcase scavenged internal combustion engine with an engine body composed of at least one crankcase body and a cylinder body, which are joined together, and the engine is provided with so called elongated scavenging ducts, which over some part of their length i.e. a crankcase part, extend in the crankcase body and have their inlet there, and over another part of their length, i.e. a cylinder part, extend in the cylinder body, wherein the crankcase part of at least one scavenging duct to a great extent is composed of an insert part with at least one inner wall facing the crankshaft assembly and provided with the inlet, so that the crankcase part of the scavenging duct is composed of the insert part alone or in combination with the inner side of the crankcase body and leads from the inlet to an outlet intended to connect to the cylinder part of the scavenging duct, said method comprising the steps of:

forming the crankcase scavenged internal combustion engine;

said step of forming the crankcase scavenged internal combustion engine comprising the following steps:

casting the cylinder body with a portion of the at least one scavenging duct;

casting the crankcase body;

forming the insert to form another portion of the at least one scavenging duct;

forming the insert with the inlet and the outlet;

inserting the insert into the crankcase body; and connecting the crankcase body to the cylinder body to at least partially enclose the insert to seal the at least one scavenging duct and to connect the portion of the at least one scavenging duct in the cylinder body to the outlet of the insert;

said method further comprising the steps of:

inserting the engine into the housing;

connecting the cutting mechanism to the housing; and operatively connecting the cutting mechanism to the engine.

* * * * *

UNITED STATES PATENT AND TRADEMARK OFFICE

CERTIFICATE OF CORRECTION

PATENT NO. : 6,491,006 B2 
DATED : December 10, 2002
INVENTOR(S) : Bo Jonsson and Mats Svensson It is certified that error appears in the above-identified patent and that said Letters Patent is hereby corrected as shown below:

Column 3,
Line 62, after “dsm.”, delete “nln”. ” and insert -- nl”. --.

Column 4,
Line 50, after “cutter.” delete “by Husqvarna AB.”.

Column 15,
Line 16, after “least”, delete “on” and insert -- one --.
Line 21, after “the”, delete “inset” and insert -- insert --.

Signed and Sealed this

Twentieth Day of May, 2003

JAMES E. ROGAN
*Director of the United States Patent and Trademark Office*